United States Patent [19]

Goode et al.

[11] 3,994,339

[45] Nov. 30, 1976

[54] SIDE POCKET MANDREL

[75] Inventors: William B. Goode; Charles Paul Lamb, both of Dallas, Tex.

[73] Assignee: Teledyne, Inc., Los Angeles, Calif.

[22] Filed: Feb. 26, 1976

[21] Appl. No.: 661,601

[52] U.S. Cl. ..... 166/117.5
[51] Int. Cl.[2] ..... E21B 7/06
[58] Field of Search..... 166/117.5; 138/DIG. 11

[56] References Cited

UNITED STATES PATENTS

| | | | |
|---|---|---|---|
| 2,679,904 | 6/1954 | Howard et al. | 166/117.5 |
| 2,828,698 | 4/1958 | Bryan | 166/117.5 |
| 2,942,671 | 6/1960 | Schramm | 166/117.5 |
| 2,959,227 | 11/1960 | Canalizo | 166/117.5 |
| 3,799,259 | 3/1974 | Dinning | 166/117.5 |

FOREIGN PATENTS OR APPLICATIONS

| | | | |
|---|---|---|---|
| 4,054 | 10/1880 | United Kingdom | 138/DIG. 11 |

*Primary Examiner*—James A. Leppink
*Attorney, Agent, or Firm*—Ralph M. Braunstein; Ronald W. Reagin

[57] ABSTRACT

A side pocket mandrel is of hollow metal tubing having a cross-section that is symmetrical about an axis and in which one of the symmetrical cross-section halves reveals a smoothly continuous convex curve, comprises a first, second and third circular arc portions of different radii and different centers of gyration; the first having a radius $r_1$, the second $r_2$, and the third a transcending radius $r_3$ with $r_1$ greater than $r_2$ and with $r_3$ being less than three times the sum of the radii $r_1$, $r_2$ and the distance between the centers of the first and second portions, but no less than one-half of such sum of $r_1$, $r_2$ and that distance between the centers.

8 Claims, 5 Drawing Figures

SIDE POCKET MANDREL

The present invention relates to an improved side pocket mandrel and, more particularly, to an improvement in the geometry of the tubing of which the side pocket mandrel is formed. The side pocket mandrel is connected in oil and gas well tubing, with the mandrels having a full opening tube bore permitting wire line, pump down or other tools to be run therethrough and having a side pocket offset form the bore to receive a retrievable valve or flow control element. In typical use the mandrel is positioned as part of oil well tubing at a predetermined depth in the well within the well casing and when desired a positioning tool, also known as a kick-over tool, is lowered down the tubing, latched onto the valve member, and is then withdrawn up the tubing removing the valve member to expose an opening in the mandrel, previously plugged by the valve member, through which liquid and/or gas at that predetermined depth may flow. The reader skilled in this art is presumed to be familiar with the prior art mandrels and their functions and the ancillary apparatus therefor, such as is presented in U.S. Pats. Nos. 2,664,162; 2,679,903; 2,679,904; 2,846,014; 2,942,671; 2,824,525; 2,828,698; 3,074,485; 3,603,393; and 2,970,648.

The side pocket mandrel of the invention is an elongated hollow metal tube of a predetermined wall thickness, $t$, which contains a shorter elongated valve pocket housing, and is of a cross-section geometry, taken perpendicular to the mandrel bore axis, that is symmetrical about an axis and in which one of the cross-section halves to one side of the axis of symmetry is defined by a first circular arc portion of a radius, $r_1$, about a point on said axis of symmetry, a second circular arc portion of a second radius, $r_2$, about a second point on said axis of symmetry, spaced from said first point by a distance, $x$, less than $3r_1-r_2$, and a third arc portion between and bridging the first and second arc portions to define therewith a smoothly continuous convex curve about said mandrel bore axis, the third arc portion having a transcending radius, $r_3$, centered at a point off of said axis of symmetry equal to or less than $3(r_1+r_2+x)$ and greater than $\frac{1}{2}(r_1+r_2+x)$.

The foregoing objects and advantages of the invention as well as the structure characteristics thereof is better understood by the reader from the detailed description of the preferred embodiments thereof, which follows, taken together with the illustrations of the embodiments presented in the drawings.

Figure 1:
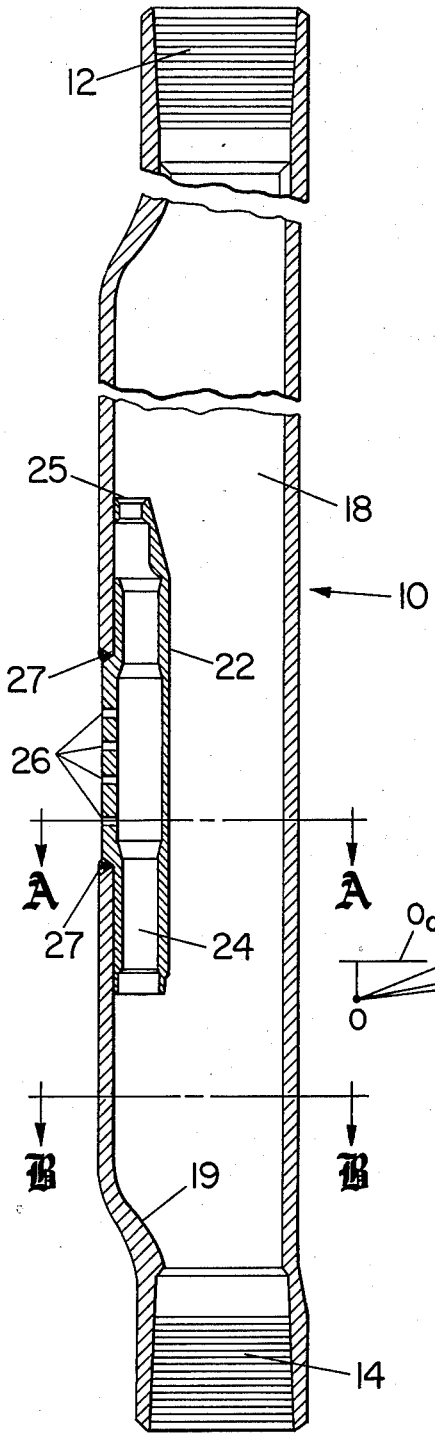
FIG. 1 is a fragmentary elevation view, in cross-section, illustrating an embodiment of a side pocket mandrel.

Reference may now be made to FIG. 1 of the drawings, in which the mandrel of the invention is generally indicated by the numeral 10 and includes threads 12 and 14 at each end for coupling the mandrel at each end to well tubing, not illustrated, with which the mandrel is connected in series. The body 20 of the mandrel includes a full open tubing bore 18 that is aligned with the well tubing to permit well tools to freely pass through. The mandrel includes a valve pocket housing 22, variously referred to simply as a side pocket, having an internal tubular valve pocket 24 for receiving a conventional valve or plug which controls the flow through inlet openings 26 to and from tubular valve pocket 24 and thereby into or out of the interior of the well tubing. The mandrel also includes a valve latching clamp 25 above side pocket 24 that cooperates with a latching means on the conventional valve, not illustrated, which in use is inserted in the side pocket, the details of either of which is not necessary to an understanding of the present invention.

As is typical of these constructions and as made apparent by the cross-section lines, the tubing of the mandrel has a cut-out or window formed in the offset wall portion and a portion of the valve pocket housing containing the inlet openings 26 is fitted within the window and secured thereto by means of welds, such as generally indicated by the numeral 27.

Figure 2:
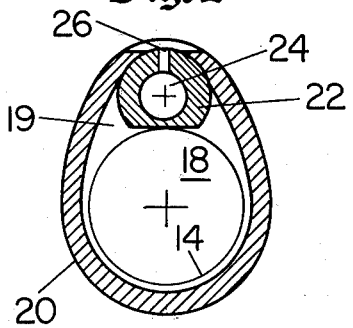
FIG. 2 is a cross-sectional view taken along the line A—A of FIG. 1.
Figure 3:
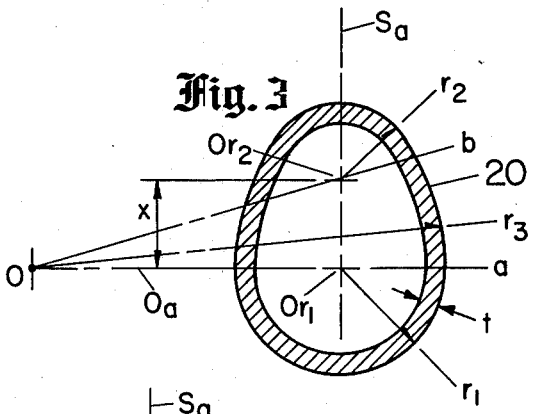
FIG. 3 is a cross-sectional view taken along the line B—B of FIG. 1.

FIG. 2 shows a cross-section of the mandrel of FIG. 1 taken along the lines A—A. In FIG. 2, like numerals identify like elements. FIG. 3 shows a cross-section of the mandrel of FIG. 1 taken along the lines B—B.

The walls 20 of the tubing that forms the mandrel 10 is better depicted in FIG. 3. For clarity, the transition portion between the offset portion and main bore near the coupling end containing threads 14, as presented in the cross-section of FIG. 2, is omitted. Moreover, there is included the various construction lines representing the various radii and axes that better serve to define the geometrical shape of the tubing cross-section.

The cross-sectional geometry of the mandrel wall 20 is symmetrical about the axis labeled $S_a$ in FIG. 3. Considering the right half of the curve, the curve includes a first circular arc portion which extends between axis $S_a$ and point $a$. This first arc portion is the lower portion of the wall 20 in FIG. 3. The first arc portion is of radius $r_1$ centered about $Or_1$. The curve also includes a second circular arc portion which extends between axis $S_a$ and point $b$. This second arc portion is the upper portion of the wall 20 in FIG. 3. The second arc portion is of a radius $r_2$ centered about $Or_2$. The separation between points $Or_1$ and $Or_2$ is designated $x$ in the figure. The curve additionally includes a third circular arc portion between points $a$ and $b$ in between and bridging the first two arc portions and essentially tangent therewith at points $a$ and $b$, respectively, to define a smooth continuous curve, convex as viewed from outside the mandrel. The third portion is of a radius $r_3$ centered at a point O that is off the axis of symmetry $S_a$ and is on a line $O_a$ drawn perpendicular to axis $S_a$ and through point $Or_1$. Separating distance $x$ is selected to be less than the sum of $r_1+r_2$ and the radius $r_3$ is equal to or less than the quantity defined by $3(r_1+r_2+x)$, three times the sum of the first and second radii and the separating distance; radius $r_3$ is further prescribed as being greater than the quantity defined by $\frac{1}{2}(r_1+r_2+x)$, one-half the sum of the first and second radii and the separating distance. With the geometry of the right half so defined, the left half being a symmetrical portion is also thereby defined. And, of course, since the wall thickness is of a finite thickness, designated $t$, the curve of the inner wall surface of the mandrel tubing is thus also defined.

The limits of the dimension $r$, are as follows. Twice $r$, should be less than the coupling diameter for the particular size of well tubing in which the mandrel is being used, which coupling diameter is determined by, for example, the standards of the American Petrolium Institute. Twice $r$, should also be greater than the sum of the drift diameter of the well tubing, as determined by the standards of the American Petroleum Institute, plus twice the thickness $t$ of the wall.

The limits of the dimension $r_2$ are as follows. First, $r_2$ must be less than $r$. Also, twice $r_2$ must be greater than the sum of the maximum diameter of a latch or running tool to be used with the mandrel plus twice the thickness $t$ of the wall.

By way of example, in one practical embodiment a mandrel of wall thickness of 0.42 inches was formed by conventional technique with $r_1$ equal to 1.75 inches, $r_2$ equal to 1.53 inches, separation distance $x$ of 1.42 inches and radius $r_3$ was equal to 6.25 inches.

Figure 4:
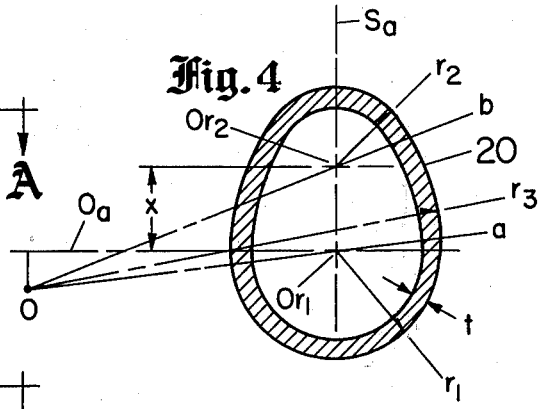
FIG. 4 is a cross-sectional view of a second embodiment and corresponds to the cross-sectional view of FIG. 3.
Figure 5:
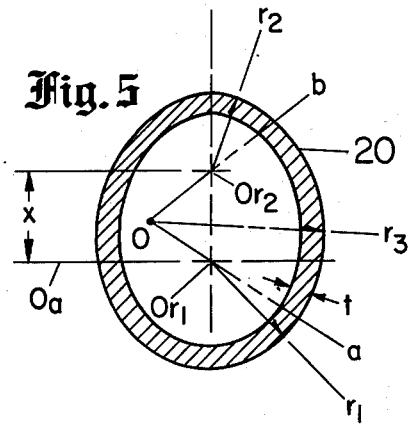
FIG. 5 is a cross-sectional view of a third embodiment and corresponds to the cross-sectional view of FIG. 3.

The same relationships are evident in the embodiments of FIGS. 4 and 5, each of which illustrates a cross-section of a second and third mandrel essentially having the same side elevation as that of the embodiment of FIG. 1, which therefore in the interests of conciseness and clarity is not illustrated, taken along the lines B—B and corresponding to the second view illustrated in FIG. 3.

For convenience, the same reference letters used in FIG. 3 are used to describe the corresponding elements defining the curve of the right half of the cross-section in each of FIGS. 4 and 5. In the cross-section view of FIG. 4, the center of radius $r_3$ is at a location of axis $S_a$ and below the line $O_a$. The points where the three arc portions forming the curve are tangent, $a$ and $b$, are at a different position from that of FIG. 3. Points $a$ and $b$, respectively, are conveniently determined by extending the radius $r_3$ from point O through the center $Or_1$ and $Or_2$, respectively.

The cross-section of the mandrel tubing of another embodiment in FIG. 5 has the center of gyration of the radius $r_3$, defining the third arc portion, located off of the axis $S_a$ and above line $O_a$. Similarly, the tangent points $a$ and $b$, determined by drawing a line from O through $Or_1$ and $Or_2$, respectively, is at a different location than in the preceding embodiments. The design of this embodiment is selected where $r_1$ and $r_2$ is given and $r_3$ and the wall thickness, $t$, can be selected to satisfy desired pressure requirements by simple computation and space conservation is not of predominant importance.

The range of the values of $r_1$, $r_2$ and $r_3$ as a function of each other, $x$ and $t$ as given above in the description of FIG. 3 are also true for the embodiments of FIGS. 4 and 5. However, in the embodiment of FIG. 3, it is presently preferred that the value of $r_3$ be defined by the following equation:

$$r_3 = \frac{x^2 + r_1^2 - r_2^2}{2(r_1 - r_2)}$$

which is within the given range.

It is believed that the foregoing description of the preferred embodiments of the invention is sufficient in detail to enable one skilled in the art to make and use the invention upon reading this specification. However, it is expressly understood that the invention is not to be limited to any such details presented for the foregoing purpose but is to be broadly construed within the full spirit and scope of the appended claims.

What is claimed is:

1. In a side pocket mandrel of the type which includes an elongated hollow tubular metal body of a predetermined relatively uniform tubular wall thickness, $t$, with coupling means at each end, said body defining a bore passage between the ends thereof, an offset portion, and a valve receiving pocket located in said offset portion and extending along a portion of said tubular body, said tubular body having a cross-section geometry that is symmetrical about an axis symmetry, the improvement wherein one symmetrical half of said cross-section defines a smoothly continuous convex curve comprising:

a first circular arc portion having an arc radius of $r_1$ with said first circular arc portion having a center $Or_1$, located on said axis of symmetry; a second circular arc portion having an arc radius of $r_2$ with said second circular arc portion having a center $Or_2$, located on said axis of symmetry and spaced from said center $Or_1$ by a predetermined spacing distance, $x$;

said distance $x$ being less than the sum of the radius $r$, and the radius $r_2$; and a third circular arc portion in between and bridging said first and second arc portions to form a smoothly continuous curve, said third arc portion having an arc radius of $r_3$, which third circular arc portion has a center at a point O located off of said axis of symmetry;

said radius $r_3$ being equal to or less than the quantity of 3 multiplied by the sum of $(x+r_1+r_2)$ and greater than the quantity of ½ multiplied by the sum of $(x+r_1+r_2)$.

2. The invention as defined in claim 1 wherein said center of said third circular arc portion is located on a line drawn through center $Or_1$ and perpendicular to said axis of symmetry.

3. The invention as defined in claim 1 wherein said center of said third circular arc portion is located below a line drawn through center $Or_1$ and perpendicular to said axis of symmetry.

4. The invention as defined in claim 1 wherein said center of said third circular arc portion is located above a line drawn through center $Or_1$ and perpendicular to said axis of symmetry.

5. The invention as defined in claim 2 in which $$r_3 = \frac{x^2 + r_1^2 - r_2^2}{2(r_1 - r_2)}.$$

6. The invention as defined in claim 1 in which twice the radius $r$, is less than the coupling diameter for the well tubing with which the mandrel is to be used and in which twice the radius $r$, is greater than the sum of the drift diameter of the well tubing plus twice the wall thickness $t$.

7. The invention as defined in claim 1 in which the radius $r_2$ is less than the radius $r_1$ and in which twice the radius $r_2$ is greater than the maximum diameter of any object to be placed in the pocket housing plus twice the wall thickness $t$.

8. In a side pocket mandrel of the type which includes an elongated hollow tubular metal body of a predetermined relatively uniform tubular wall thickness, $t$, with coupling means at each end, said body defining a bore passage between the ends thereof, an offset portion, and a valve receiving pocket located in said offset portion and extending along a portion of said tubular body, said tubular body having a cross-section geometry that is symmetrical about an axis of symmetry, the improvement wherein one symmetrical half of said cross-section comprises:

a first circular arc portion having a first radius $r_1$ located on said axis of symmetry; a second circular arc portion having a second radius $r_2$ having its center located on said axis of symmetry and spaced from the center of the first circular arc portion by a predetermined spacing distance; and a third curved portion in between bridging said first and second arc portions to form a smoothly continuous convex curve.

* * * * *